US007154444B2

(12) United States Patent
Sievenpiper

(10) Patent No.: US 7,154,444 B2
(45) Date of Patent: Dec. 26, 2006

(54) GROUND PLANE COMPENSATION FOR MOBILE ANTENNAS

(75) Inventor: Daniel F. Sievenpiper, Los Angeles, CA (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/407,556

(22) Filed: Apr. 4, 2003

(65) Prior Publication Data

US 2004/0196197 A1 Oct. 7, 2004

(51) Int. Cl.
*H01Q 1/32* (2006.01)

(52) U.S. Cl. ..... 343/713

(58) Field of Classification Search ..... 343/700 MS, 343/713, 911 R, 711, 878
See application file for complete search history.

(56) References Cited

U.S. PATENT DOCUMENTS 5,682,168 A * 10/1997 James et al. ..... 343/713
6,028,557 A * 2/2000 Oka ..... 343/713
6,118,410 A * 9/2000 Nagy ..... 343/713
6,198,447 B1 * 3/2001 Sauer ..... 343/713
6,215,449 B1 * 4/2001 O'Neill, Jr. ..... 343/713
6,292,150 B1 * 9/2001 Doi et al. ..... 343/713
6,552,690 B1 * 4/2003 Veerasamy ..... 343/713
6,624,794 B1 * 9/2003 Wendt et al. ..... 343/864
2003/0117328 A1 * 6/2003 Sievenpiper et al. ..... 343/713
2003/0164801 A1 * 9/2003 Jordan ..... 343/713

* cited by examiner

*Primary Examiner*—Trinh Dinh
*Assistant Examiner*—Huedung Mancuso
(74) *Attorney, Agent, or Firm*—Laura C. Hargitt

(57) ABSTRACT

An antenna system improves the radiation pattern of an antenna on a vehicle. An antenna includes a ground plane and receives RF signals. The antenna is mounted on a vehicle surface in close proximity to a vehicle window. A conductive structure is located on the vehicle window adjacent to the vehicle surface and communicates with the antenna. The conductive structure extends the ground plane of the antenna.

28 Claims, 6 Drawing Sheets

GROUND PLANE COMPENSATION FOR MOBILE ANTENNAS

FIELD OF THE INVENTION

The present invention relates to mobile antennas, and more particularly to a mobile antenna with an improved radiation pattern.

BACKGROUND OF THE INVENTION

Designers of vehicles commonly mount antennas on an outer surface of a roof of the vehicle. The roof or another planar surface of the vehicle acts as a ground plane for the antenna. Typically, the antenna is located in close proximity to a vehicle window. The performance of the antenna is proportional to the size of the ground plane. Increasing the size of the ground plane improves a radiation pattern of the antenna.

The optimal position for the antenna is in the center of the roof. The antenna can use the entire roof surface as a ground plane. The current trend in vehicle design is to conceal the antenna from view. The center of the roof, however, is a highly visible location. For aesthetic reasons, the antenna is often mounted at or near the edge of a vehicle surface, which reduces the effective size and symmetry of the ground plane. The positioning of the antenna in this manner degrades the performance of the antenna.

Some antennas are mounted at the edge of the roof surface in close proximity to a window. This location may allow radiation to propagate into the passenger compartment. To reduce the radiation into the passenger compartment and improve the radiation pattern of the antenna, a wire grid is located on the window adjacent to the antenna. The wire grid reduces radiation into the passenger compartment, and offsets the performance degradation caused by the asymmetrical ground plane.

SUMMARY OF THE INVENTION

An antenna system improves the radiation pattern of an antenna on a vehicle. An antenna includes a ground plane and receives radio frequency (RF) signals. The antenna is mounted on a vehicle surface in close proximity to a vehicle window. A conductive structure that communicates with the antenna is located on the vehicle window adjacent to the vehicle surface. The conductive structure extends the ground plane of the antenna.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1A:
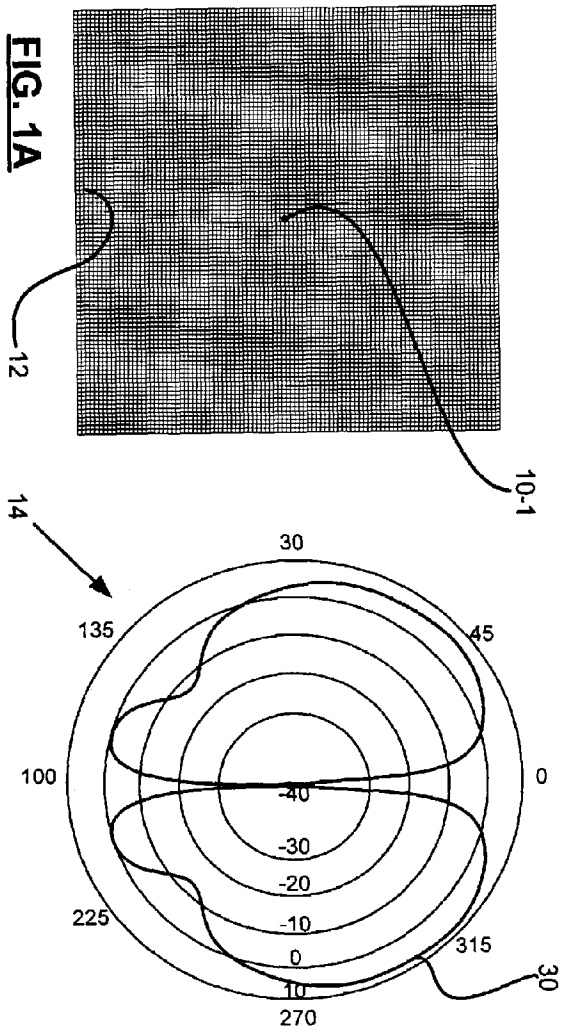
FIG. 1A Prior Art
FIG. 1A illustrates an optimally configured ground plane according to the prior art.

The following description of the preferred embodiments is merely exemplary in nature and is in no way intended to limit the invention, its application, or uses. For purposes of clarity, the same reference numbers will be used in the drawings to identify similar elements.

Figure 1B:
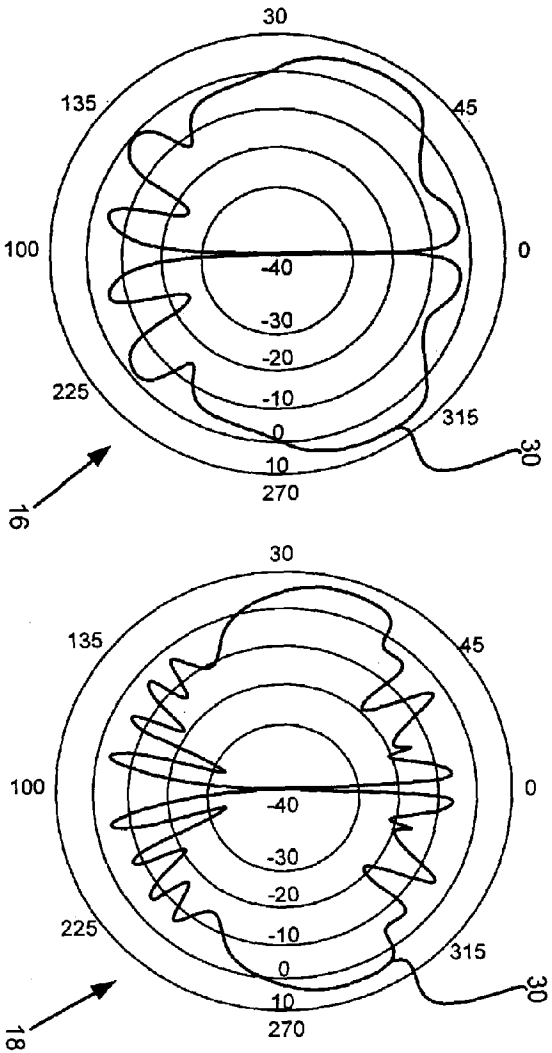
FIG. 1B Prior Art
FIG. 1B illustrates a radiation pattern for the antenna of FIG. 1A.

Referring to FIGS. 1A and 1B, a monopole antenna 10-1 is positioned at a center of a ground plane 12. For example, the ground plane 12 can be one square meter. The radiation patterns for the antenna 10-1 are shown for various frequencies such as 0.5 GHz, 1.0 GHz, and 2.0 GHz at 14, 16, and 18, respectively. The radiation pattern data is obtained using finite difference time domain simulations. Because the ground plane 12 is square, only co-pol radiation 30 is shown. With respect to monopole antenna radiation, co-pol describes the projection of the electric field vector onto an elevation, or theta, direction. The co-pol radiation patterns 30 are symmetrical at all tested frequencies and represent the ideal radiation pattern.

In FIGS. 1B, 2B, 3B, and 4B, the radiation patterns for the monopole antenna 10-1 are taken at an elevation plane that cuts diagonally across the ground plane. The elevation plane intersects the ground plane at a 45 degree azimuth angle.

Figure 2A:
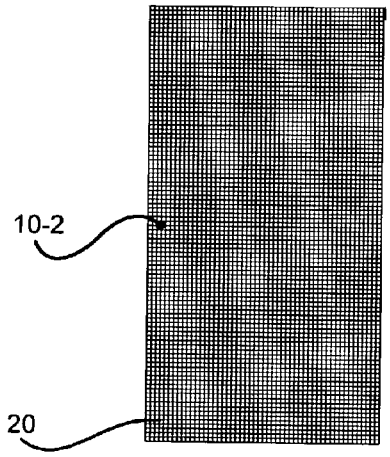
FIG. 2A Prior Art
FIG. 2A illustrates a reduced ground plane according to prior art.
Figure 2B:
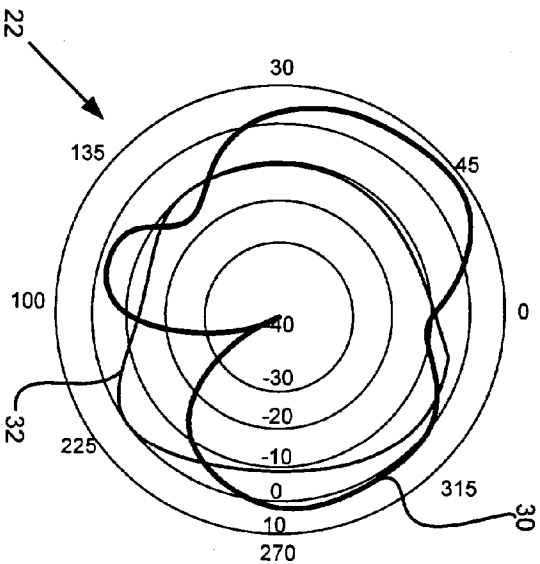
FIG. 2B Prior Art
FIG. 2B illustrates a radiation pattern for the ground plane of FIG. 2A.
Figure 2B:
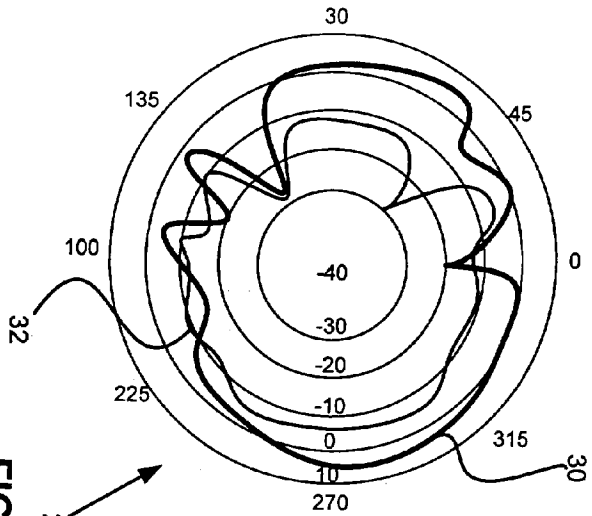
FIG. 2B Prior Art
Figure 2B:
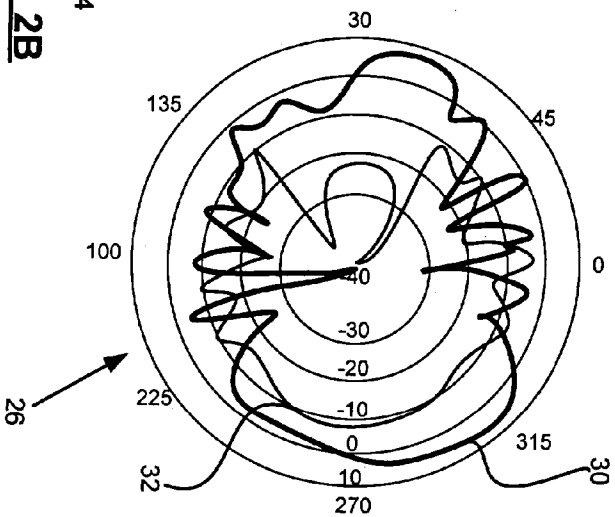
FIG. 2B Prior Art

Referring now to FIGS. 2A and 2B, a monopole antenna 10-2 is located on a reduced, rectangular ground plane 20. For example, the ground plane 20 is one meter by sixty centimeters. By reducing the ground plane 20, the monopole antenna 10-2 is located closer to an edge of the ground plane 20. The resulting radiation patterns taken at 0.5 GHz, 1.0 GHz, and 2.0 GHz are shown at 22, 24, and 26, respectively. Both co-pol radiation 30 and cross-pol radiation 32 are shown to illustrate the asymmetry of the antenna 10-2. With respect to antenna radiation, cross-pol describes the projection of the electric field vector onto the azimuth, or phi, direction.

The co-pol radiation pattern 30 for all frequencies is highly asymmetrical. Similarly, the cross-pol radiation pattern 32 for all frequencies shows significant cross-pol energy. These characteristics do not meet the performance standards for modern high data rate communication systems such as satellite radio and certain cellular systems.

Figure 3A:
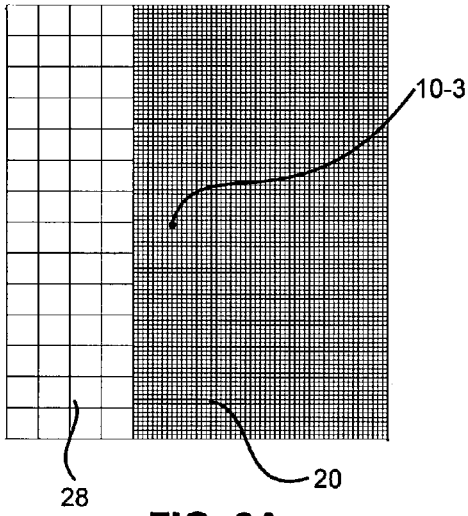
FIG. 3A illustrates a reduced ground plane extended by a wire grid having inadequate spacing.
Figure 3A:
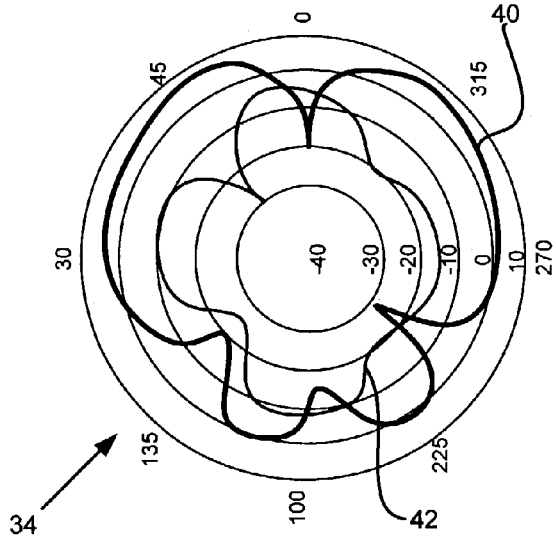
Figure 3B:
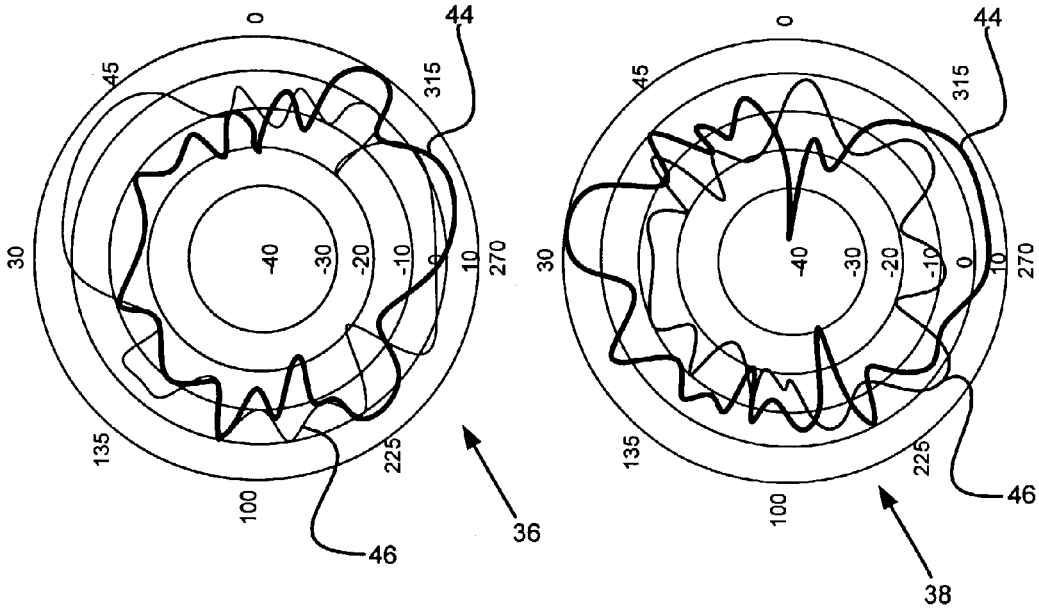
FIG. 3B illustrates a radiation pattern for the reduced ground plane of FIG. 3A.

Referring now to FIGS. 3A and 3B, a monopole antenna 10-3 is again located near the edge of the reduced ground plane 20. A wire grid 28 is attached along one edge of the ground plane 20. For example, the wire grid 28 may have a wire spacing of one-sixth wavelength, or ten centimeters.

Radiation patterns for 1.0 GHz (shown at 36) and 2.0 GHz (shown at 38) are unacceptable and do not meet the performance standards. A co-pol radiation pattern 44 is highly asymmetrical and a cross-pol radiation pattern 46 shows significant cross-pol energy. Although a rectangular wire grid is shown, other shapes and configurations of the wire grid may be used.

The radiation pattern for 0.5 GHz (shown at 34) is marginally acceptable. The co-pol radiation pattern 40 is fairly symmetrical, and the cross-pol radiation pattern 42 shows only moderate cross-pol energy. These characteristics barely meet performance standards. Therefore, the wire grid spacing of one-sixth wavelength provides marginally acceptable performance.

Figure 4A:
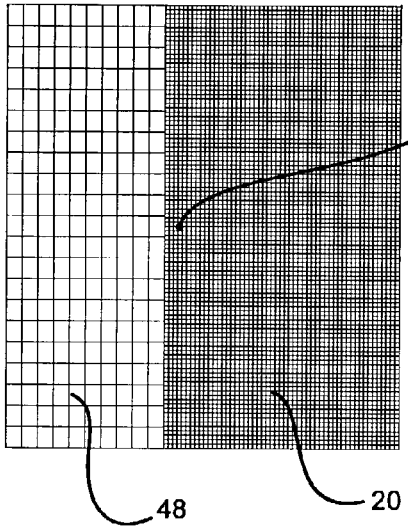
FIG. 4 illustrates a reduced ground plane extended by a wire grid having adequate spacing.
FIG. 4B illustrates the radiation pattern for the reduced ground plane of FIG. 4A.
Figure 4A:
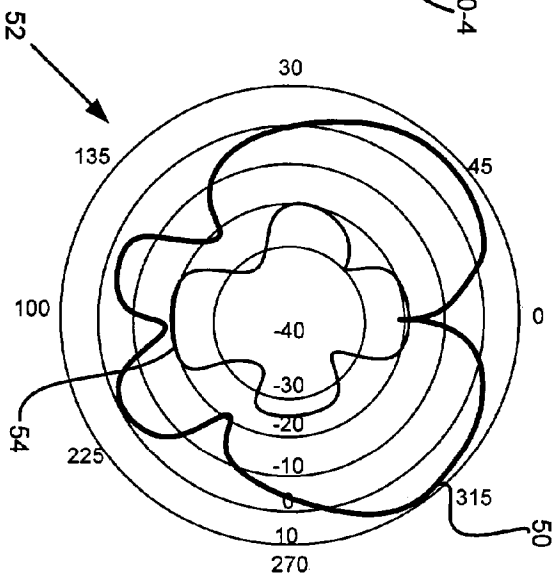
Figure 4B:
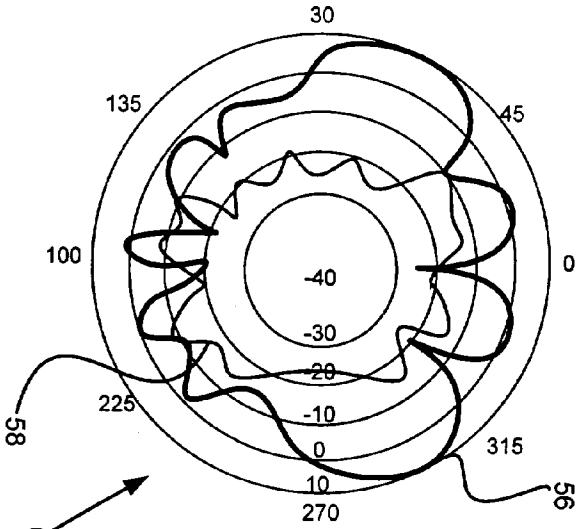
Figure 4B:
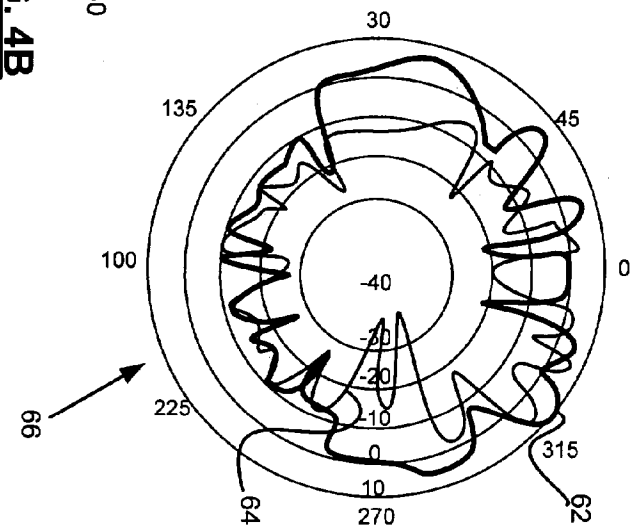

Referring now to FIGS. 4A and 4B, the monopole antenna 10-4 is again located near the edge of the reduced ground plane 20. A wire grid 48 having wire spacing of one-twelfth wavelength, or five centimeters is used. A co-pol radiation pattern 50 for 0.5 GHz (shown at 50) is fairly symmetrical and otherwise acceptable for performance standards. A cross-pol radiation pattern 54 shows moderately low energy and also meets performance standards. The radiation patterns at 0.5 GHz demonstrate a significant performance improvement due to the use of a wire grid having one-twelfth wavelength wire spacing.

Still referring to FIG. 4, the co-pol radiation pattern 56 and cross-pol radiation pattern 58 at 1.0 GHz (shown at 60) are marginally acceptable. A co-pol radiation pattern 62 and a cross-pol radiation pattern 64 at 2.0 GHz (shown at 66) remain unacceptable for performance standards.

Figure 5:
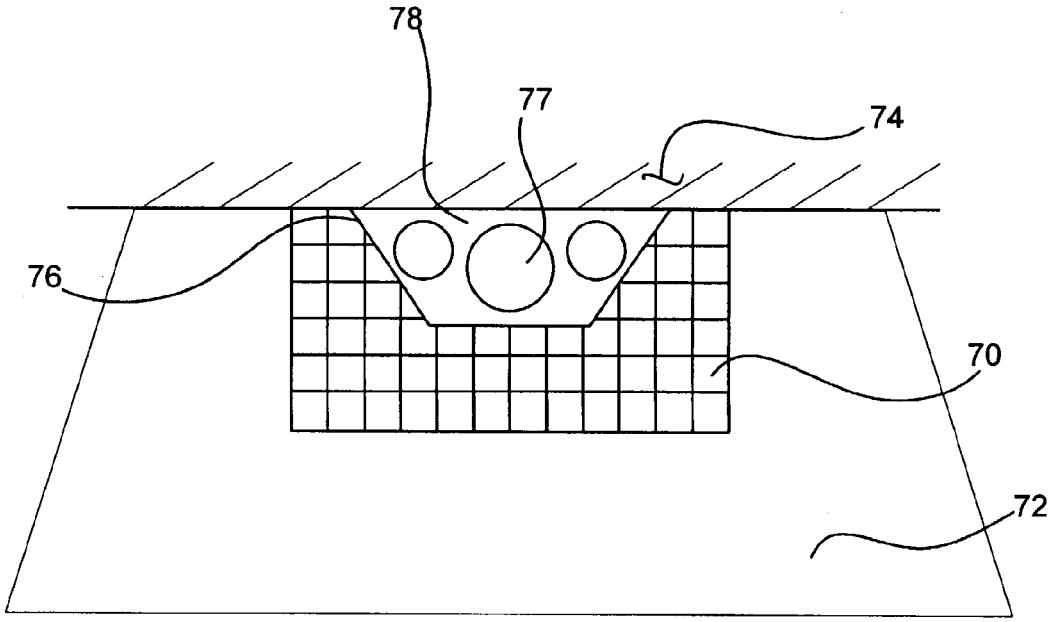
FIG. 5 illustrates an antenna module mounted at a roof edge adjacent to a window.

Referring now to FIG. 5, a ground plane extension in the form of a wire grid 70 is printed on a vehicle window 72 in close proximity to an edge of the vehicle roof 74. An opening 76 in the wire grid 70 allows antennas 77 within the antenna module 78 to radiate through the wire grid 70. The antennas 77 may be suited to communicate with terrestrial RF signals, high data rate satellite signals, or GPS signals. Although several antennas 77 are shown, it is to be understood that any number of antennas 94 may be supported by the antenna module 78.

The wire grid 70 extends the ground plane of the antenna module 78 to improve the performance of the antennas 77. The wire grid 70 may also be implemented as any suitable conductive structure that provides a low impedance path for current. In one embodiment, the conductive structure is a transparent conductor such as indium tin oxide or silver film. The transparency of the conductive structure allows optical radiation to penetrate the window in the vicinity of the wire grid 70. Spacing between the wires in the wire grid 70 does not significantly obstruct optical radiation.

Although one-twelfth wavelength wire spacing for the wire grid 70 is acceptable for performance standards, spacing can be reduced to less than one-twelfth wavelength to further improve the performance. Wire spacing can also be effectively reduced to zero using a solid conductive sheet. The solid conductive sheet may be constructed of transparent conductors, such as indium tin oxide or a conducting polymer, to maintain optical transparency. Additionally, the wire grid 70 may be constructed of a similar transparent conductor.

Figure 6:
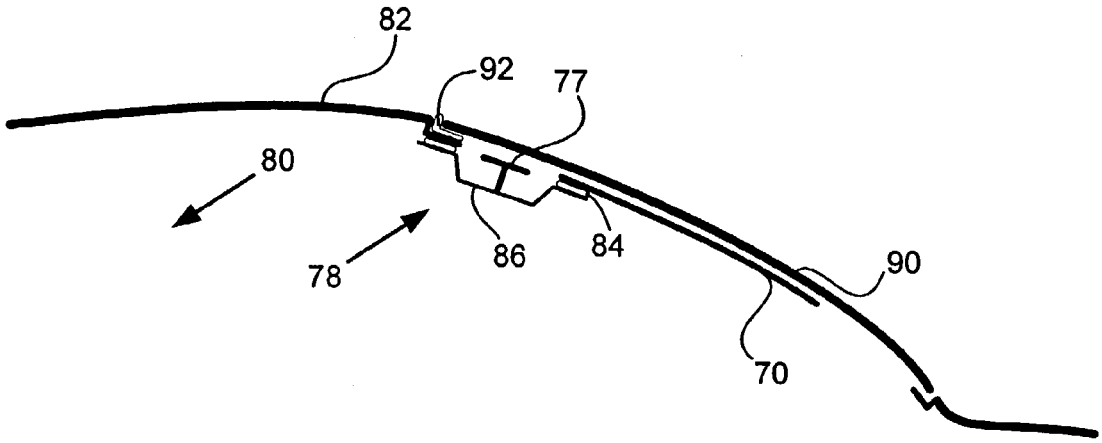
FIG. 6 illustrates an antenna module with an integrated ground plane mounted at a roof edge.

Referring to FIG. 6, the antenna module 78 is mounted within a vehicle interior 80 and attached to a vehicle body 82 and the wire grid 70 with conductive adhesive 84. An integrated ground 86 disposed on the antenna module 78 connects the antenna module 78 to the vehicle body 82 and the wire grid 70. The wire grid 70 is printed on the inner surface of the vehicle window 90. The vehicle window 90 may be attached to the vehicle body 82 using normal adhesive 92.

The integrated ground 86 performs as an internal ground plane for the antennas 77 mounted within the antenna module 78. The integrated ground 86 connects to both the vehicle body 82 and the wire grid 70. As a result, the ground plane is extended sufficiently to maintain acceptable antenna radiation patterns.

Alternatively, a capacitive method may be substituted for conductive adhesive 84 to conductively connect the integrated ground 86 to the vehicle body 82 and the wire grid 70. The capacitive method arranges two conducting structures, which are separated by a thin layer of dielectric, in close proximity. The dielectric may be a non-conductive adhesive that attaches the conducting structures together. If the overlap area between the conducting structures is sufficiently large and the separation between the conducting structures is sufficiently small, the structures will be continuous to electromagnetic waves. A separation distance of several hundred microns coupled with an overlap area of several centimeters effectively provides a continuous ground connection for RF waves at relevant frequencies.

Figure 7:
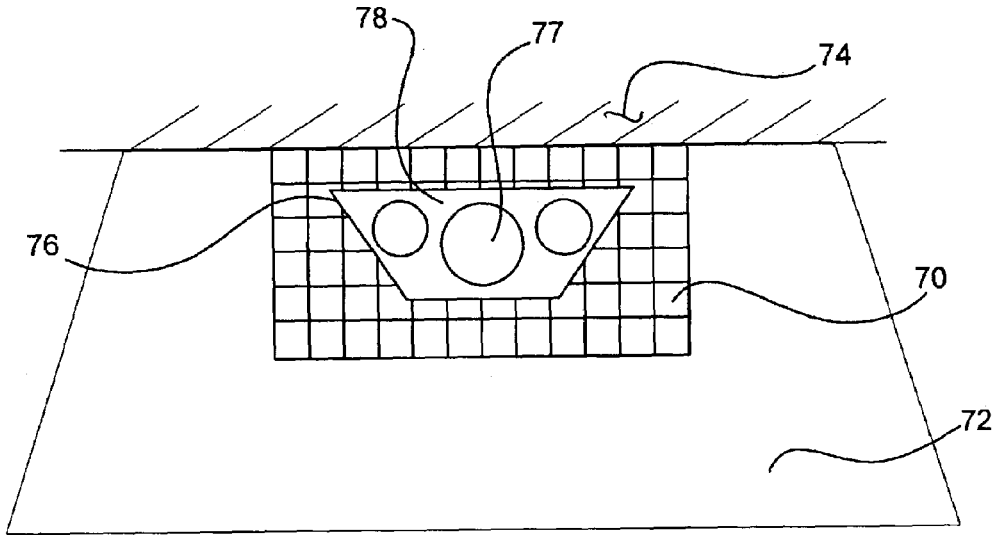
FIG. 7 illustrates an antenna module mounted within a wire grid.
Figure 8:
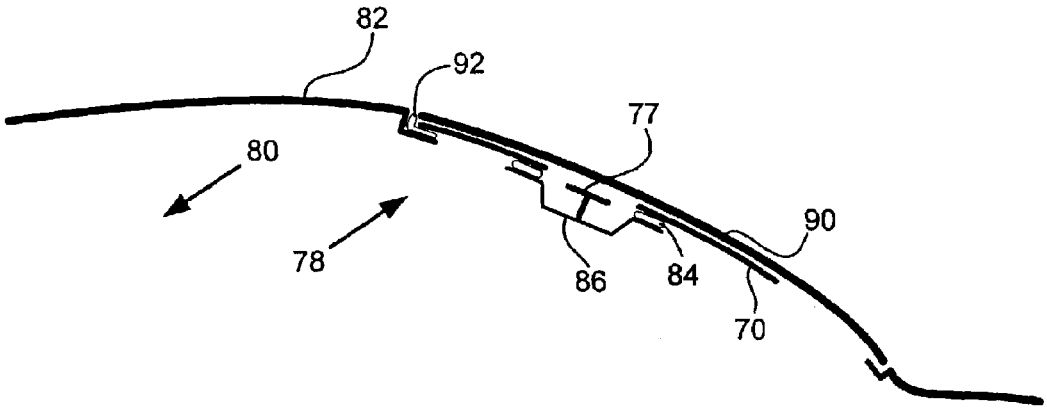
FIG. 8 illustrates an antenna module with an integrated ground plane mounted within a wire grid.

Referring now to FIGS. 7–8, an alternative embodiment for mounting the antenna module 78 is shown. The antenna module 78 is disposed further from the vehicle body 82. The antenna module 78 is disposed entirely within the periphery of the wire grid 70. The integrated ground 86 is attached exclusively to the wired grid 70, and the wire grid 70 is attached to the vehicle body 82. Attachment is achieved with conductive adhesive 84 or the conductive method as described above. In this embodiment, the order of assembly of the antenna system is irrelevant because the antenna module 78 may be attached to the vehicle window 90 before or after the vehicle window 90 is attached to the vehicle body 82. Additionally, this arrangement allows for easier window replacement.

It is to be understood that where the vehicle body is described, any metallic vehicle element adjacent to a window may be used, such as a roof, trunk, hood, or other metallic components. Additionally, where a vehicle window is described, any suitable window may be used, such as a windshield, rear window, or side windows.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

The invention claimed is:

1. An antenna system for improving the radiation pattern of an antenna on a vehicle comprising:

an antenna that includes a ground plane and receives radio frequency (RF) signals, and that is mounted on a conductive vehicle surface in close proximity to a vehicle window; and a conductive structure that communicates with the antenna and that is located on the vehicle window adjacent to the conductive vehicle surface, wherein the conductive structure extends the ground plane of the antenna.

2. The antenna system of claim 1, wherein the conductive structure is a wire grid having wire spacing that improves the radiation pattern of the antenna.

3. The antenna system of claim 2, wherein the RF signals have a first wavelength and the wire spacing is less than or equal to one-twelfth of the first wavelength.

4. The antenna system of claim 1, wherein the conductive structure is substantially transparent to optical radiation.

5. The antenna system of claim 1, wherein the antenna is a receive-only antenna.

6. The antenna system of claim 1, wherein the conductive structure provides a low impedance path for current.

7. The antenna system of claim 1, wherein the conductive structure is a transparent conductor.

8. The antenna system of claim 7, wherein the transparent conductor is a transparent conducting polymer.

9. The antenna system of claim 1, wherein the conductive structure is a solid sheet of conductive material.

10. The antenna system of claim 1, wherein the antenna is mounted in an interior of the vehicle.

11. The antenna system of claim 1, wherein the antenna is mounted on the conductive vehicle surface using a conductive adhesive.

12. The antenna system of claim 1, wherein the antenna is separated from the conductive vehicle surface by a dielectric material and the antenna and the conductive vehicle surface are continuous to electromagnetic waves.

13. The antenna system of claim 12, wherein the dielectric material is an adhesive.

14. A method for improving the radiation pattern of an antenna on a vehicle comprising:

mounting an antenna that includes a ground plane and receives RF signals on a conductive vehicle surface in close proximity to a vehicle window; and locating a conductive structure on the vehicle window adjacent to the conductive vehicle surface, wherein the conductive structure communicates with the antenna and extends the ground plane of the antenna.

15. The method of claim 14, wherein the conductive structure is a wire grid having wire spacing that improves the radiation pattern of the antenna.

16. The method of claim 15, wherein the RF signals have a first wavelength and the wire spacing is less than or equal to one-twelfth of the first wavelength.

17. The method of claim 14, wherein the conductive structure is substantially transparent to optical radiation.

18. The method of claim 14, wherein the antenna is a receive-only antenna.

19. The method of claim 14, wherein the conductive structure provides a low impedance path for current.

20. The method of claim 14, wherein the conductive structure is a transparent conductor.

21. The method of claim 14, wherein the transparent conductor is a transparent conducting polymer.

22. The method of claim 14, wherein the conductive structure is a solid sheet of conductive material.

23. The method of claim 14, wherein mounting an antenna includes mounting the antenna in an interior of the vehicle.

24. The method of claim 14, wherein mounting an antenna includes mounting the antenna on the conductive vehicle surface using a conductive adhesive.

25. The method of claim 14, wherein mounting an antenna includes arranging a dielectric material between the antenna and the conductive vehicle surface whereby the antenna and the conductive vehicle surface are continuous to electromagnetic waves.

26. The method of claim 25, wherein the dielectric material is an adhesive.

27. An antenna system for improving the radiation pattern of an antenna on a vehicle comprising:

an antenna that includes a ground plane and receives radio frequency (RF) signals, and that is mounted on a vehicle window; and a conductive structure that is located on the vehicle window and that communicates with the antenna and a conductive vehicle surface, wherein the conductive structure surrounds the antenna and extends the ground plane of the antenna.

28. A method for improving the radiation pattern of an antenna on a vehicle comprising:

mounting an antenna that includes a ground plane and receives RF signals on a vehicle window; and locating a conductive structure on the vehicle window that communicates with the antenna and a conductive vehicle surface, wherein the conductive structure surrounds the antenna and extends the ground plane of the antenna.

* * * * *